United States Patent [19]

West

[11] 4,335,285

[45] Jun. 15, 1982

[54] FLOAT OPERATED ELECTRICAL SWITCH ASSEMBLY

[75] Inventor: Norman West, High Wycombe, England

[73] Assignee: Bestobell Mobrey Limited, Slough, England

[21] Appl. No.: 122,046

[22] Filed: Feb. 19, 1980

[30] Foreign Application Priority Data

Feb. 20, 1979 [GB] United Kingdom ..... 7905876

[51] Int. Cl.[3] ..... H01H 35/18

[52] U.S. Cl. ..... 200/84 C; 340/625; 335/207

[58] Field of Search ..... 73/308, 313, 319; 335/205-207; 340/624, 625; 200/84 R, 84 C, 81.4

[56] References Cited

U.S. PATENT DOCUMENTS 2,671,834 3/1954 Kmiecik ..... 200/84 C

FOREIGN PATENT DOCUMENTS 2241199 3/1974 Fed. Rep. of Germany .... 200/84 C 1490266 10/1977 United Kingdom .

*Primary Examiner*—Gerald P. Tolin

*Attorney, Agent, or Firm*—Kane, Dalsimer, Kane, Sullivan & Kurucz

[57] ABSTRACT

A float operated electrical switch assembly has a housing (10) fitted to an opening in a container wall (14). A float (19) follows the liquid level and is pivoted with a primary magnet (18) about a pivot axis (17). A pivotal secondary magnet (21) acts in repulsion with the primary magnet (18) through a non-magnetic wall (20) of the housing (10). The movement of the secondary magnet (21) causes at least one control rod (48) to reciprocate. A switch contact (32) is normally held under the resilience of its carrier leaf spring (38) in engagement with a fixed switch contact (33). The contacts are opened by movement of the control rod (48) moving the switch contact (32) against the resilience of its carrier.

10 Claims, 7 Drawing Figures

FLOAT OPERATED ELECTRICAL SWITCH ASSEMBLY

The invention is concerned with a float-operated electrical switch assembly, for use with a boiler or other liquid container. The assembly has a float which follows the liquid level and is mounted with a primary magnet on the wet side of the assembly so that the primary magnet moves upon movement of the float. The primary magnet controls the movement of a secondary switch magnet by magnetic influence through a non-magnetic wall. The secondary magnet is mounted on the dry side of the assembly and its movement controls the operation of electrical switch contacts. Such an assembly is hereinafter referred to as of the kind described.

In a typical example the primary and secondary magnets are bar magnets pivotally mounted about horizontal axes with the two magnets substantially in axial alignment one on each side of the non-magnetic wall, with adjacent poles of the two magnets similar to one another. When the float rises or falls, the remote operative end of the primary magnet adjacent to the non-magnetic wall falls or rises respectively and causes the adjacent end of the secondary magnet to pivot upwards or downwards respectively with a snap action when the magnetic repulsion force between the adjacent poles of the two magnets passes through a dead centre position. Other configurations are possible.

In a conventional arrangement, the secondary magnet has carried two electrically connected electrically conducting cantilevered leaf springs at the ends of which electrical contacts are carried. In one stable end position of the secondary magnet the movable contacts on the leaf springs touch one pair of fixed contacts, making the circuit between the two fixed contacts. Similarly a circuit is made between two other fixed contacts when the secondary magnet is in its other stable end position.

The contact pressure between the movable and fixed contacts is determined by the flexure of the cantilevered leaf springs, produced from the torque available from the interaction of the two magnets. Because of the limited magnet size and strength, and the necessary separation between the magnet poles, this torque is very small. The conventional arrangements require that this torque uses the angular movement available to produce an air gap between the two end positions of the moving contacts when resting on the fixed contacts, plus flexure of the cantilevered leaf springs each way sufficient to produce the contact force. The problem is multiplied by the simultaneous closing of two pairs of contacts, since the available force has to be divided between both pairs and the angular movement may be limited by the flexure of one of the leaf springs before sufficient contact has occured at the other pair of contacts. Consequently the contact force is frequently less than would be desirable, particularly where the assembly may be subjected to vibration, or low voltage signal currents of low magnitude are to be switched. The carriage of the moving contacts by the secondary magnet introduces a further problem that the contacts are in the proximity of moving parts and dust is liable to build up on the contacts, particularly when, owing to the geometry of the secondary magnet mounting, the contact surfaces are horizontal. Such dust will interfere with good electrical contact between the fixed and moving contacts. The carriage of the moving contacts by the secondary magnet also necessarily involves the use of ceramic or other insulating material in the vicinitiy of the secondary magnet and such material is susceptible to deterioration upon prolonged exposure to high temperatures as may occur when the assembly is used in high temperature applications.

In accordance with the present invention, a float operated electrical switch assembly of the kind described has a secondary magnet which swings between two stable end positions under the control of the primary magnet, the secondary magnet operating at least one pair of switch contacts of which a first contact is fixed and a second contact is mounted on a contact carrier and is resiliently urged into engagement with the first contact to complete part of an electrical circuit, and the secondary magnet being coupled to the contact carrier by a longitudinally movable control rod which, in one end position of the secondary magnet, does not interfere with the resilient engagement of the first and second contacts but which, when the secondary magnet swings to its other end position, moves longitudinally and moves the contact carrier against the resilient urging to disengage the second contact from the first contact and open the circuit part.

This use of a simple control rod which operates directly between the contact carrier and a part which moves with the secondary magnet, such as a pivoted carrier in which the secondary magnet is fixed, leads to a number of advantages. A particular advantage is that the contact pressure between the first and second switch contacts is constant and determined by the resilient loading, the magnetic interaction only providing the force and movement required to create the air gap between the contacts when broken, rather than air gap plus two deflections of the leaf springs.

The effects of vibration on this switch are much less than on previous designs, since the contacts which are "made" only include the contact carrier and movable second contact as movable parts. Vibration affects these much less than the normal arrangement where a pivoted magnet carries the "made" electrical contacts. The pivoted magnet in this novel design only affects the electrical contact in the "broken" position. In the other position the control rod is not in rigid contact with the contact carrier.

Although the reaction provided by the resilient urging to hold the contacts closed must not be so great that it will not be overcome by the reaction along the control rod when the secondary magnet swings over to its other end position, the reaction can be considerably greater than with the conventional arrangement previously mentioned if the moment arm between the line of action of the control rod and the pivotal axis of the secondary magnet is small. This can easily be achieved since the movement required from the control rod is much less than that required previously from the contact bearing leaf springs.

The use of an axially reciprocating control rod also enables the switch contacts to be positioned in a chamber separated from other moving parts, such as the secondary magnet, by a partition having an aperture through which the control rod works. This assists in keeping the surfaces of the contacts clean. The use of the control rod also eliminates the conventional restriction on the orientation of the contacts and they can be mounted with their faces vertical, irrespective of the orientation of the pivotal axis of the secondary magnet, thereby further inhibiting the settlement of dust on the contact faces.

The resilience urging the second contact into engagement with the first contact may be a separate spring, interposed between the contact carrier and a part of the switch housing. Preferably, however, the resilience is provided by the contact carrier itself which is then in a form of a cantilevered leaf spring. The second contact is mounted adjacent to the free end of the leaf spring and the control rod engages the leaf spring adjacent to the second contact. The leaf spring may also act as the current carrier from the second contact to another part of the circuit.

Furthermore since the contacts are no longer carried by the secondary magnet, all the components adjacent to the secondary magnet, and hence close to the hotter, wet side of the assembly in a high temperature application, can be made of metal.

We have disclosed in our British Pat. No. 1,490,266 a switch assembly of the kind described in which a similar control rod was provided between the secondary magnet and a microswitch. However that construction was much more complex, involving a number of moving parts, such as levers and buttons, between the control rod and the moving parts of the microswitch. The advantage in the present case arises from the direct engagement of the control rod with the contact carrier to create the air gap when the contacts are opened.

Further advantages arise over the systems previously described which used conventional microswitches. The electrical contacts on cantilevered leaf springs can be made suitable for operation up to 400° C. or more, whereas commercially available microswitches are limited to 120° C. Significantly higher temperature versions of low force microswitches would be very expensive, if available at all. Also the microswitches suitable for low force actuation normally require small contact gaps to be sensitive to the low forces available from the magnet. This restricts the maximum operational current rating possible, since the low contact gap on breaking the circuit can cause an arc across this gap, particularly with inductive loads. With the present invention the contact gap available may be increased. A further economic advantage is that for switches designed for intrinsically safe electrical circuits, where low voltages and current are present, the normal practice with contact surfaces is to gold plate these for better performance. Gold plating of the low actuating force microswitches is subject to very large minimum order quantities and a high price surcharge compared to the standard products, making their use for this application uneconomic. The switches according to the present invention can easily be manufactured using gold plates contacts in small numbers at only the necessary extra cost compared to the normal silver contacts.

The advantages of the new switch assembly are achieved irrespective of whether the longitudinally movable control rod acts in compression or tension to push or pull respectively the contact carrier and hence disengage the second contact from the first contact. In either case the contact carrier may be engaged by a shoulder on the control rod. However, there is a marginal preferance for the control rod to act in compression to push the contact carrier to disengage the second contact from the first contact and it may then be the tip of the control rod remote from the secondary magnet which bears against the contact carrier and there is no need for a reduced cross sectional part of the control rod to extend past the contact carrier with possible danger of frictional engagement between the reduced cross sectional part and the contact carrier at the time when the control rod is moving with a lost motion relatively to the contact carrier. In the alternative case in which the control rod acts in tension to pull the contact carrier to disengage the second contact from the first contact, it will be necessary for the control rod to be axially restrained relatively to the secondary magnet carrier or other part through which the secondary magnet is coupled to the control rod. Such restraint may also be provided when the control rod acts to push the contact carrier to disengage the second contact from the first contact. Such restraint may be provided by fixing the control rod to a part rotatably mounted in the secondary magnet carrier about an axis substantially parallel to that about which the secondary magnet is pivotally mounted. Such pivotal mounting of the control rod relatively to the secondary magnet carrier allows the control rod to rock to and fro relatively to the secondary magnet to accommodate changes in the transverse distance between the control rod and axis of the secondary magnet as the secondary magnet rocks between its limited angular positions.

A single control rod may operate two circuit parts if there are two pairs of the switch contacts with the second contact of each pair mounted on a contact carrier and resiliently urged into engagement with the respective first contact, the control rod, when it moves in one direction, moving one of the contact carriers to disengage the respective second contact from the corresponding first contact and open one circuit part, and, when it moves in the other direction, moving the other contact carrier to disengage the respective second contact from the corresponding first contact and open the other circuit part. At any time one of the pairs of contacts will then be held open by the reaction arising from the magnetic interaction and the other pair of contacts will be closed under the resilient urging.

The arrangement in which a control rod operates one or two pairs of contacts as described may be duplicated on opposite sides of the secondary magnet axis. One of the control rods will then move in one direction and the other control rod in the other direction and the secondary magnet swings to one of its end positions, and vice versa when the secondary magnet swings to its other end position. If each of the control rods only operates a single pair of contacts, the reaction arising from the magnetic interaction will, in either end position of the secondary magnet, only be used to hold one contact carrier against its resilient urging. However, if both control rods operate two pairs of contacts, the single secondary magnet can be used to control four circuit parts, although in that case only half the reaction arising from the magnetic interaction will be available to hold each pair of contacts open.

Examples of a switch assembly constructed in accordance with the present invention are illustrated in the accompanying drawings, in which.

Figure 1:
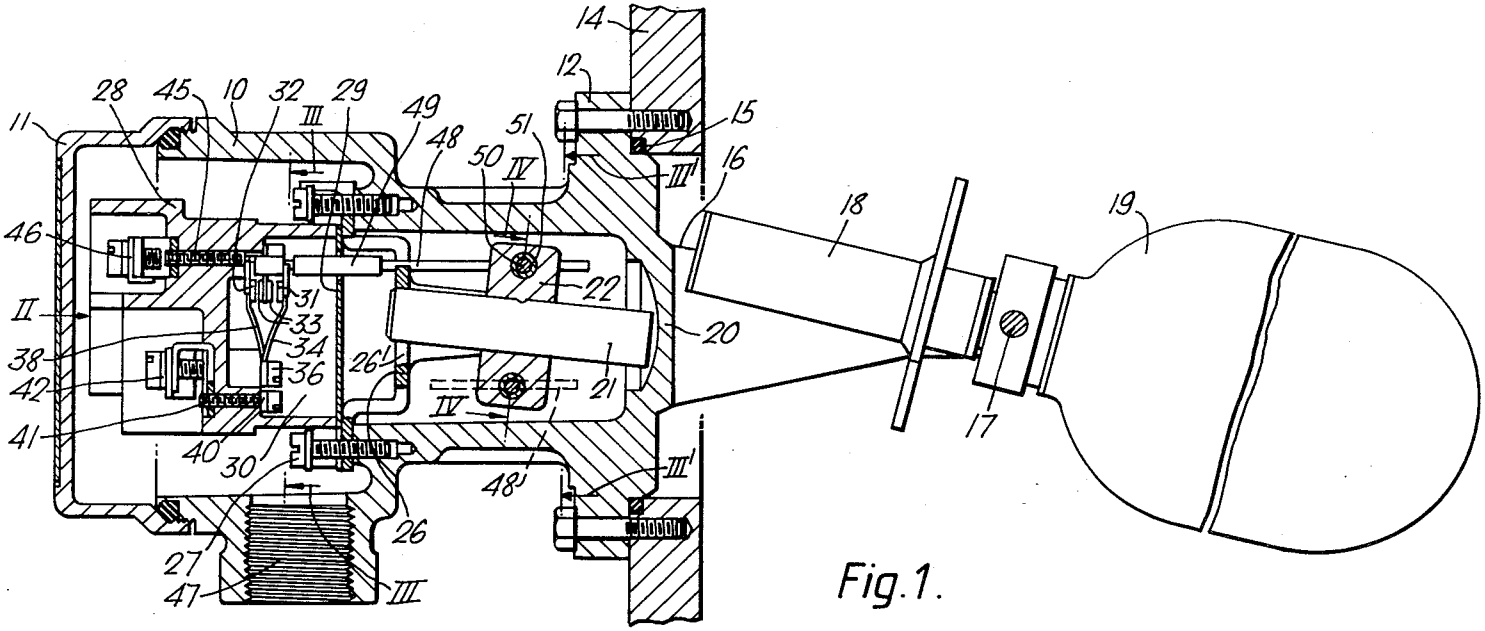
FIG. 1 is a diagrammatic vertical section through one assembly, and taken on the line I—I in FIG. 2.
Figure 4:
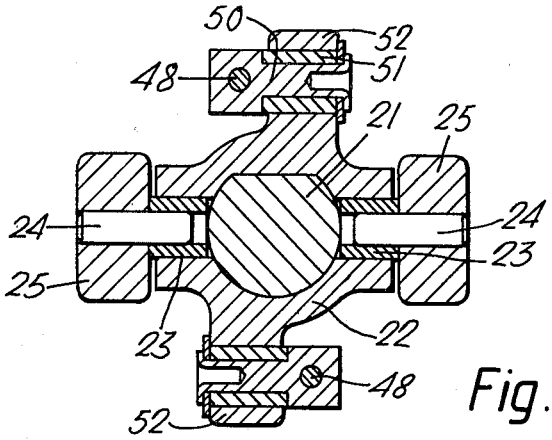
FIG. 4 is a section taken on the line IV—IV in FIG. 1.
Figure 3:
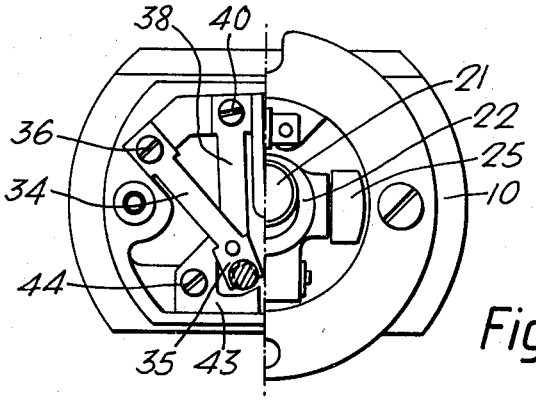
FIG. 3 is a section taken partly on the line III—III and partly on the line III′—III′ in FIG. 1.
Figure 2:
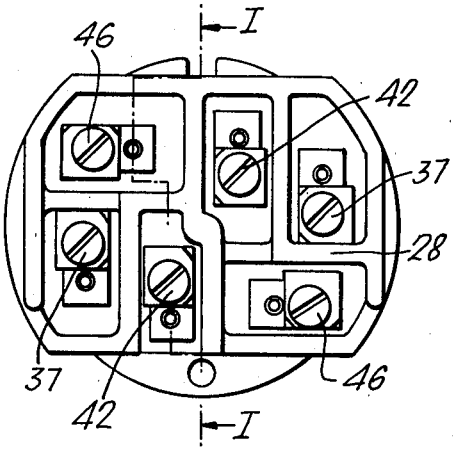
FIG. 2 is an end elevation of a switch unit as seen in the direction of the arrow II in FIG. 1.

The switch assembly illustrated in FIGS. 1 to 5, comprises a housing 10 made of stainless steel or other non magnetic material closed by a screw on end cap 11. The housing 10 is provided with an integral annular flange 12 through which studs or bolts 13 pass to secure the flange to a side wall 14 of a liquid container around an opening in the container wall. A sealing ring 15 is interposed between the flange and wall. A pair of parallel ears 16, integral with the housing 10, extend through the opening in the container wall 14 and support between them on a pivot 17 a pivotable assembly including a primary bar magnet 18 and a float 19. The float 19 rises and falls with the liquid level in the container but the angle through which the pivotable assembly can swing is limited by abutments (not shown) on the ears 16 and assembly. FIG. 1 shows the low liquid level position of the pivotable assembly.

The end of the primary magnet 18 remote from the float 19 moves closely adjacent to a thin diaphragm 20, or so-called non-magnetic wall portion, of the housing 10 and cooperates by repulsion through the diaphragm 20 with a like pole at the adjacent end of a secondary magnet 21. The magnet 21 is fixed in a surrounding metal carrier 22 having journals 23 (FIG. 4) which receive stub axles 24 carried by parallel ears 25 formed integrally with a metal insert 26 which is secured by a pair of screws 27 within the housing 10. The secondary magnet 21 and carrier 22 are thus able to swing about a horizontal axis parallel to the axis 17 and their angular movement is limited by engagement of the inner end of the magnet 21 with the edges of an opening 26' in the insert 26. FIG. 1 shows the end position of the secondary magnet 21 corresponding to the illustrated end position of the primary magnet 18 and float 19. Naturally when the float 19 rises with the liquid level in the container, the two magnets will pass through a magnetic dead centre position as a result of which the secondary magnet will snap over in an anticlockwise direction as seen in FIG. 1 to its other end position.

Also held in the housing 10 by the pair of screws 27 is a moulded insert 28 made of insulating material with a thin partition 29 sandwiched between the inserts 26 and 28 to define within the insert 28 a switch chamber 30. Within the chamber 30 are two sets of switch contacts, of which one set are visible in FIG. 1, the other set being symmetrically arranged on the opposite side of the axis of the switch unit. The set of switch contacts seen in FIG. 1 consist of movable switch contacts 31 and 32 cooperating with respective ones of a pair of fixed contacts 33 arranged back to back. The moving contact 31 is carried at the end of a carrier consisting of an electrically conducting metal leaf spring 34 having a U-shaped, and U-sectioned operating extension 35. The other end of the leaf spring 34 is secured and electrically connected by a screw 36 to an internally tapped tubular metal conductor cast into the insert 28 and electrically connected to a terminal 37 positioned at the rear face of the insert 28. The movable contact 32 is similarly carried at the end of an electrically conducting metal leaf spring 38, having an operating extension 39. The other end of the leaf spring 38 is secured and electrically connected bv a screw 40 to an internally tapped tubular conductor 41 which is cast into the insert 28 and electrically connected at its other end to a terminal 42 positioned alongside the terminal 37. The contacts 33 are carried one on each side of an electrically conducting metal strip 43 secured and electrically connected by a screw 44 to another tubular conductor 45 cast in the insert 28 and electrically connected to a terminal 46. In practice the two sets of terminals 37, 42 and 46 would be connected to external control or indication equipment by leads in a cable extending out of the housing 10 through an opening 47.

Each set of switch contacts is operated by a control rod 48 having a metal part which is connected to the secondary magnet carrier 22 and an enlarged ceramic end 49 which operates the switch contacts directly. Each rod extends through an opening in the insert 26 and an opening in the partition 29. As will be apparent from FIG. 4, each of the control rods 48 is fixed in a holder 50 which is pivotally mounted in a bushing 51 carried by a wing 52 of the carrier 22. As a result, as the secondary magnet 21 and its carrier 22 are rocked to and fro by the primary magnet and float assembly, one control rod 48 moves longitudinally in one direction or the other and the other control rod moves a similar amount in the opposite direction. The pivotal mounting provided by the bushing 51 enables the control rods to rock relatively to the carrier 22 to accommodate the angular movement.

Figure 5:
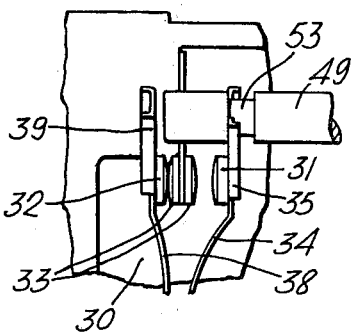
FIG. 5 is an enlargement of part of FIG. 1 to show the operation of two pairs of switch contacts by a control rod.

As shown in FIG. 5, the ceramic end 49 of each control rod is provided with a reduced diameter annular groove 53 of greater axial length than the thickness of the operating extension 35. However the arms of the U of the extension 35 fit within the groove 53 so as to be abutted by the shoulders at the ends of the groove upon longitudinal movement of the control rod. The tip of the control rod is positioned adjacent to the operating extension 39.

The natural resilience of the leaf springs 34 and 38, acting as carriers for the moving contacts 31 and 32, are such that the moving contacts are urged into engagement with their respective fixed contacts 33 with adequate contact force to carry the necessary current. However in each end position of the secondary magnet 21, one or other of the switch contacts 31 or 32 is forced away from its respective fixed contact 33 against the resilience of its leaf spring carrier. Thus when the secondary magnet 21 is in its limited position shown in FIG. 1, the upper control rod 48 will have been moved backward to the position shown in FIG. 5 in which the switch contacts 31 and 33 are open but the switch contacts 32 and 33 are closed. Simultaneously, the other control rod will have been moved in the opposite direction and its tip will have moved the operating extension 39 of the other set of contacts so that in that set the contacts 32 and 33 are open but the contacts 31 and 33 closed. Both sets of switch contacts will switch over to their opposite positions when the secondary magnet 21 is rocked in an anti-clockwise direction as seen in FIG. 1 to its other end position.

Figure 6:
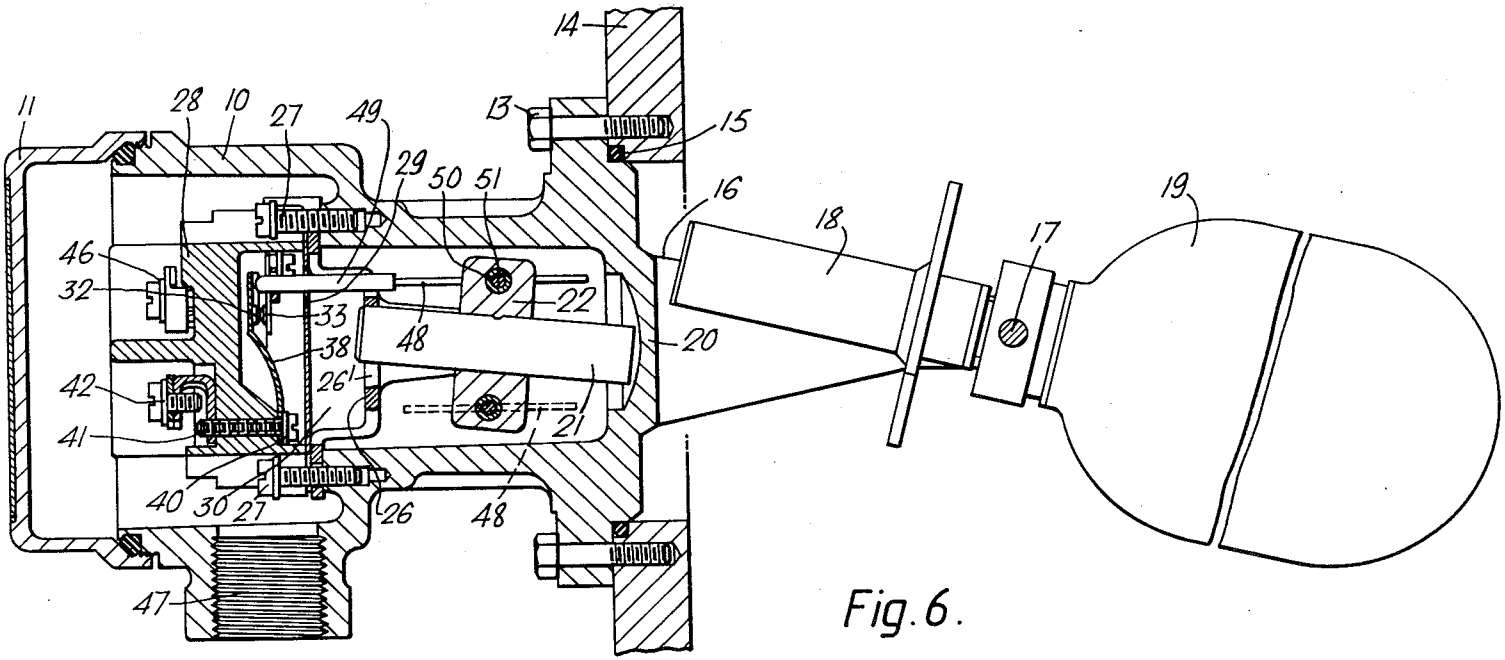
FIG. 6 is a section similar to FIG. 1 but of a second assembly.
Figure 7:
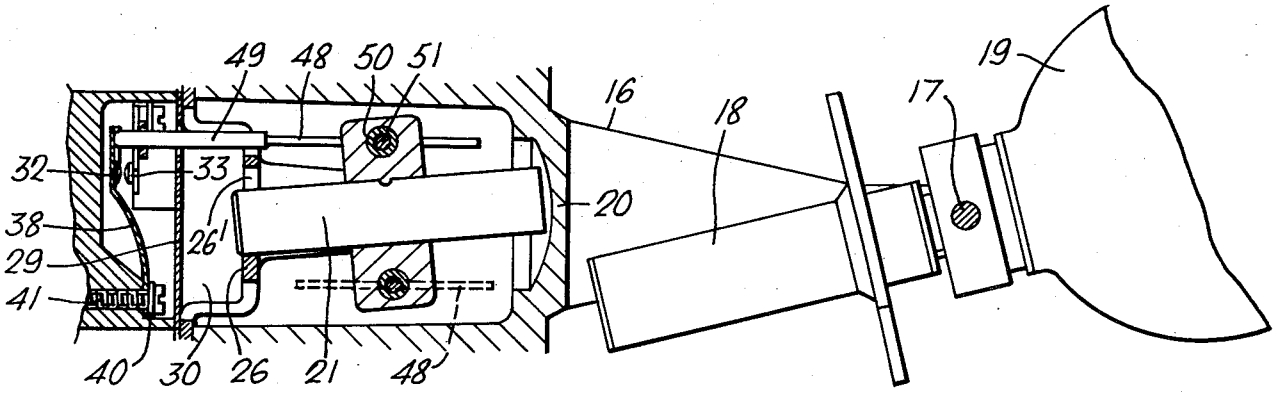
FIG. 7 is a section similar to part of FIG. 6 but showing the parts in a different operative position.

The second example illustrated in FIGS. 6 and 7 is a simple modification of the first example and the float, magnets, and switch housing are of similar construction as is indicated by the use of similar reference numerals. The essential difference is that the movable switch contact 31 and its associated parts have been eliminated, and consequently also the annular groove 53 in the ceramic end 49 of each control rod. The insert 28 will have been modified slightly to accommodate the modification wherein each set of contacts includes only two contacts and will require only two respective terminals.

In this modification the control rods only open the contacts when they are moved to the left as seen in FIGS. 6 and 7 so that in each end position of the secondary magnet 21, the whole reaction available from the magnetic repulsion between the magnets 18 and 21 is available to move only a single one of the leaf spring contact carriers 38. FIG. 6 shows the upper control rod having been withdrawn so that the switch contacts are closed under the resilience of the leaf spring 38 and FIG. 7 shows the control rod having been moved to the left to open the contacts.

I claim:-

1. In a float-operated switch assembly having a float mounted with a primary magnet on a wet side of said assembly so that said primary magnet moves, in use, upon movement of said float, said primary magnet controlling the movement of a secondary switch magnet by magnetic influence through a non-magnetic wall, and said secondary magnet being mounted on a dry side of said assembly and its movement controlling the operation of electrical switch contacts; the improvement wherein said secondary magnet swings between two stable end positions under the control of said primary magnet, said secondary magnet operating at least one pair of switch contacts of which a first contact is fixed and a second contact is mounted on a contact carrier and is resiliently urged into engagement with said first contact to complete part of an electrical circuit, and said secondary magnet being coupled to said contact carrier by a longitudinally movable control rod directly engaging the contact carrier and which, in one of said end positions of said secondary magnet, does not interfere with the resilient engagement of said first and second contacts but which, when said secondary magnet swings to the other of said end positions, moves longitudinally and moves said contact carrier against said resilient urging to disengage said second contact from said first contact and open said circuit part, and in the one end position of the secondary magnet the resilient engagement of the first and second contacts being independent of any connection of the contacts to the secondary magnet or of the exact position of the secondary magnet.

2. An assembly according to claim 1, wherein said control rod acts in compression to push said contact carrier to disengage said second contact from said first contact.

3. An assembly according to claim 2, wherein there are two pairs of the said switch contacts with the second contact of each of said pairs mounted on a respective contact carrier and resiliently urged into engagement with the respective first contact, said control rod, when it moves in one direction, moving one of said contact carriers to disengage said respective second contact from said corresponding first contact and open one circuit part, and, when it moves in the other direction, moving the other of said contact carriers to disengage said respective second contact from said corresponding first contact and open another circuit part.

4. An assembly according to claim 1 or claim 3, wherein the provision of said control rod and said at least one pair of said switch contacts is duplicated on both sides of the pivotal axis of said secondary magnet.

5. An assembly according to claim 1, wherein the resilience urging said second contact into engagement with said first contact is provided by said contact carrier itself which is in the form of a cantilevered leaf spring.

6. An assembly according to claim 5, wherein said leaf spring also acts as the current carrier from said second contact.

7. An assembly according to claim 1, wherein said switch contacts are mounted with contact faces thereof substantially vertical.

8. An assembly according to claim 1 or claim 7, wherein said switch contacts are positioned in a chamber separated from said secondary magnet by a partition having an aperture through which said control rod works.

9. An assembly according to claim 1, wherein said control rod is fixed to a part pivotally connected to a carrier for said secondary magnet about an axis substantially parallel to that about which said secondary magnet is pivotally mounted.

10. A switch assembly for high temperature applications, and according to claim 1, wherein said secondary magnet is surrounded by a metal carrier, and said control rod has at one end a metal part connected to said carrier and at the other end a ceramic part cooperating with said contact carrier.

* * * * *